US005928501A

United States Patent [19]

Sudhakar et al.

[11] Patent Number: 5,928,501

[45] Date of Patent: Jul. 27, 1999

[54] PROCESS FOR UPGRADING A HYDROCARBON OIL

[75] Inventors: Chakka Sudhakar, Fishkill; Mark T. Caspary, Glenham; Stephen J. DeCanio, Montgomery, all of N.Y.

[73] Assignee: Texaco Inc., White Plains, N.Y.

[21] Appl. No.: 09/017,587

[22] Filed: Feb. 3, 1998

[51] Int. Cl.[6] ..... C10G 17/00; C10G 45/04

[52] U.S. Cl. ..... 208/263; 208/216 R; 208/216 PP; 208/217; 208/114; 208/27; 585/270

[58] Field of Search ..... 208/263, 216 R, 208/216 PP, 217, 114, 27; 585/270

[56] References Cited

U.S. PATENT DOCUMENTS

| | | |
|---|---|---|
| 4,528,089 | 7/1985 | Pecoraro et al. . |
| 4,666,878 | 5/1987 | Jacobson et al. . |
| 5,389,241 | 2/1995 | Sudhaker et al. . |
| 5,435,907 | 7/1995 | Sudhakar et al. . |
| 5,449,452 | 9/1995 | Sudhakar et al. . |
| 5,462,651 | 10/1995 | Sudhakar et al. . |
| 5,472,595 | 12/1995 | Sudhakar et al. . |
| 5,529,968 | 6/1996 | Sudhakar et al. . |
| 5,538,929 | 7/1996 | Sudhakar et al. . |
| 5,624,547 | 4/1997 | Sudhakar et al. . |

*Primary Examiner*—Helane Myers

*Attorney, Agent, or Firm*—Henry H. Gibson; Dilworth & Barrese

[57] ABSTRACT

A process for treating a hydrocarbon oil feed to reduce total acid number (TAN) and increase API gravity employs a catalyst which includes one or more metals of non-noble Group VIII of the periodic table (e.g., iron, cobalt and nickel), and at least one metal selected from Group VIB (e.g., chromium, tungsten and molybdenum) on a phosphorus treated carbon support, the phosphorus treated carbon support being comprised of phosphorus bound to the carbon surface predominantly as polyphosphate species characterized by peaks between −5 and −30 ppm in the solid-state magic angle spinning $^{31}P$ nuclear magnetic resonance spectrum. The process includes blending the catalyst with the hydrocarbon oil feed to form a slurry which is then treated with hydrogen at moderate temperature and pressure in, for example, a tubular reactor. Deposit formation is minimized or avoided.

23 Claims, 1 Drawing Sheet

PROCESS FOR UPGRADING A HYDROCARBON OIL

BACKGROUND OF THE INVENTION

1. Field of the Invention

The present invention relates to a method for treating a hydrocarbon oil, and more particularly to a method for upgrading a heavy oil feedstock by catalyst assisted hydrotreatment.

2. Description of the Related Art

Crude oils range widely in their composition and physical and chemical properties. In the last two decades the need to process heavier crude oils has increased. Heavy crudes are characterized by a relatively high viscosity and low API gravity (generally lower than 25°) and high percentage of high boiling components. To facilitate processing, such heavy crudes or their fractions are generally subjected to thermal cracking or hydrocracking to convert the higher boiling fractions to lower boiling fractions, followed by hydrotreating to remove heteroatoms such as sulfur, nitrogen, oxygen and metallic impurities.

Acidic compounds, particularly naphthenic acids, are often found in crude oils. Naphthenic acids are carboxylic acids having a ring structure, usually of five member carbon rings, with side chains of varying length. Such acids are corrosive towards metals and must be removed, for example, by treatment with aqueous solutions of alkalis such as sodium hydroxide to form alkali naphthenates. However, with increasing molecular weight the alkali naphthenates become more difficult to separate because they become more soluble in the oil phase and are powerful emulsifiers.

The acidic content of a hydrocarbon oil is measured by the total acid number, or "TAN", which is defined as the milligrams of potassium hydroxide (KOH) necessary to neutralize the acid in 1 gram of oil. Typical refineries can process crudes having a TAN of up to 0.3. Some crude oils have TAN's of more than 4.0, making it difficult to process such oils.

What is needed is a process to upgrade heavy acidic hydrocarbon oils to simultaneously reduce acidity and increase API gravity. Moreover, an upgrading process operating at moderate pressures would be economical to set up and easy to operate.

SUMMARY OF THE INVENTION

In accordance with the present invention a process for treating a hydrocarbon oil feed is provided which comprises:

a) forming a slurry which includes a heavy hydrocarbon oil and a catalytically effective amount of a catalyst composition comprising a non-noble metal of Group VIII of the periodic table and a metal of Group VIB of the periodic table on a phosphorus-treated carbon support;

b) introducing the slurry into a reaction zone in the presence of hydrogen; and, c) subjecting the slurry to acid number reducing conditions to provide a hydrocarbon oil product having a lower acid number and increased API gravity.

The process achieves the reduction of acid number of hydrocarbon oil feeds while increasing the API gravity and reducing the sulfur. Deposit formation on the interior walls of the reactor is minimized.

BRIEF DESCRIPTION OF THE DRAWING

Various embodiments are described herein with reference to the drawing wherein.

DETAILED DESCRIPTION OF PREFERRED EMBODIMENTS

Figure 1:
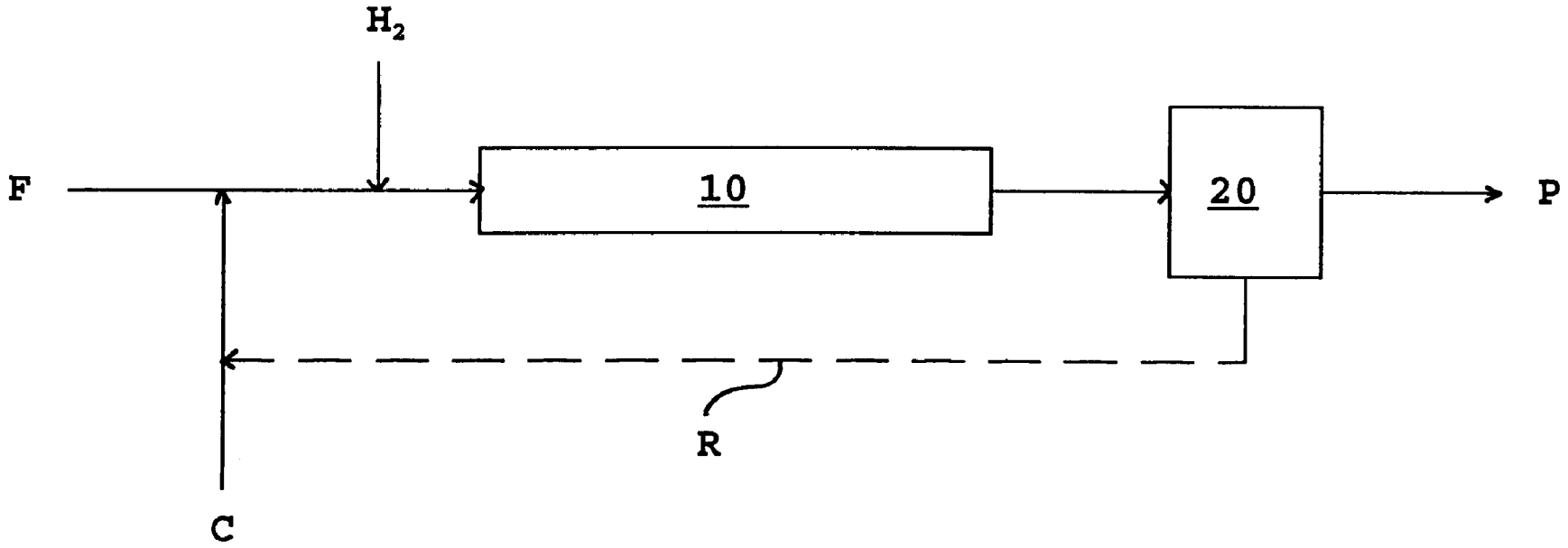
FIG. 1 is a diagrammatic view of the process of present invention.

The present method utilizes the carbon supported catalyst described in U.S. Pat. No. 5,529,968 to Sudhakar et al., herein incorporated by reference in its entirety, to upgrade hydrocarbon oils, particularly heavy oils. The present method is especially useful to reduce the TAN of highly acidic heavy crudes while increasing the API gravity and reducing the sulfur content of the oil. The TAN of the hydrocarbon oil product of the present method is less than about 50% of that of the hydrocarbon oil feed, preferably less than about 30%, and more preferably less than about 20% that of the hydrocarbon oil feed. The API gravity can be increased by at least 1° in the process of the present invention. The oil laden with the catalyst particles is subjected to moderate temperatures and pressures in the presence of hydrogen, after which the catalyst can be recovered and recycled back into the process.

Various types of reactors can be used to accomplish upgrading of the hydrocarbon oil. For example, one suitable type of reactor is a fluidized bed reactor wherein a slurry of the hydrocarbon feed containing the carbon supported catalyst is reacted in a fluidized bed. Another suitable reactor system is an ebullated bed reactor wherein spent catalyst is continuously removed and fresh or regenerated catalyst is continuously added.

However, most preferred is a simple visbreaker-like process in which the catalyst is premixed with the hydrocarbon oil to form a slurry. The slurry along with added hydrogen is then fed through a heated tubular reactor. This process is represented in FIG. 1, which is now referred to.

Feedstock F of the present invention can be any whole crude oil, dewatered and/or desalted crude oil, topped crude oil, deasphalted oil, crude oil fractions such as vacuum gas oil and residua, water emulsions of crude oil or heavy fractions of the crude oil, oil from coal liquefaction, shale oil, or tar sand oil. Typically, such feedstocks have low API gravities of the order of 25° or less, and many possess TAN numbers greater than 0.3.

It should be further noted that the process of the present invention may also be used as an API gravity upgrading process for heavy hydrocarbon oils that do not possess any significant acidity.

The catalyst C for use in the method described herein comprises preferably 0.1% to 15% by weight of one or more metals of non-noble Group VIII of the periodic table and preferably 1% to about 50% of one or more metals selected from Group VIB of the periodic table, as discussed more fully below. The catalytic metal is deposited on a phosphorus-treated carbon support.

More particularly, the phosphorus treated carbon support of the catalysts used in the method described herein is preferably prepared using an activated carbon precursor or starting material. All carbons with B.E.T. surface areas more than 100 $m^2/g$, derived from raw materials such as coal, wood, peat, lignite, coconut shell, olive pits, synthetic polymers, coke, petroleum pitch, coal tar pitch, etc., existing in any physical form such as powder, pellets, granules, extrudates, fibers, monoliths, spheres, and the like are suitable as precursors for preparing the instant phosphorus treated carbon support. Granulated carbon blacks may also be employed as precursors. The activated carbon starting material can contain small concentrations of phosphorus (on the order of about 1% by weight), or can be phosphorus free.

The phosphorus-treated carbon support of the catalysts of the present invention is prepared by incorporating one or more of inorganic, organic or organometallic phosphorus compounds such as ammonium phosphates, alkyl phosphates, urea phosphate, phosphoric acid, and phosphorus pentoxide into the activated carbon starting material. Addition by impregnation of the activated carbon with solution can be carried out by dissolving the phosphorus based compound and impregnating the carbon. Alternatively, the carbon material can be thoroughly mixed with the phosphorus-based compound in a solid or slurry state. Phosphorus can also be introduced into the carbon through vapor or gas phase, using suitable phosphorus compounds, at appropriate conditions. The activated carbon/phosphorus compound mixture is subjected to a heat treatment after impregnation. The heat treatment step requires subjecting the activated carbon/phosphorus compound mixture to a temperature from about 450° to about 1200° C. This heat treatment is believed to convert most of the phosphorus to polyphosphate species bound to the carbon surface, which show characteristic peaks between −5 and −30 ppm in their $^{31}P$ magic angle spinning solid-state nuclear magnetic resonance spectrum. The peaks due to these phosphorus species also have characteristic spinning side-bands due to a large chemical shift anisotropy.

The Total Surface Area (Brunauer-Emmett-Teller, BET) of the phosphorus treated carbon support should be at least about 100 $m^2/g$, and typically between 600 $m^2/g$ and 2000 $m^2/g$. The Total Pore Volume (TPV) for nitrogen is at least about 0.3 cc/g, preferably 0.4–1.2 cc/g, say 0.8 cc/g. The Average Pore Diameter by nitrogen physisorption, is in the range of 12–100 Angstroms, preferably 16–50 Angstroms, say 30 Å. Preferably 20–80% of the total pore volume of the phosphorus treated carbon support should exist in pores in the mesopore range (20–500 Å diameter). The phosphorus treated carbon support used to prepare the catalysts of the present invention can exist in any physical form including, but not limited to powder, granules, pellets, spheres, fibers, monoliths, or extrudates. It may also contain inert refractory inorganic oxides as minor components, the total of these minor components being less than about 20% by weight. The phosphorus level in the phosphorus treated carbon support of the catalysts of the present invention may range from about 0.1% to 10% by weight, measured as elemental phosphorus. The preferred range is between 2.5% and 10% phosphorus by weight in the support.

The catalyst includes from about 1% to about 50% by weight based on total catalyst weight of one or more Group VIB metals selected from chromium, molybdenum and tungsten. Preferably, the chromium and/or molybdenum together can constitute from 1% to 20% by weight, calculated as elemental chromium or molybdenum. The preferred range is 5–18% by weight, more preferably about 12% by weight. However, tungsten is the most preferred and constitutes 1–50% by weight of the catalyst, more preferably 10–45% by weight, and most preferably about 37% calculated as elemental tungsten and based on the final catalyst weight. The catalyst includes from about 0.1% to about 15% by weight of one or more non-noble Group VIII metal selected from nickel, cobalt and iron. The preferred range for one or more metals selected from nickel, iron or cobalt is from 2 to 10% by weight, preferably 7%, calculated as elemental Group VIII metal and based on the final catalyst weight. Nickel is the preferred Group VIII metal. The catalyst of the present invention can also contain promoters such as boron and fluorine, at 0.01% to 4% by weight calculated as elemental boron or fluorine, based on the total catalyst weight.

The catalytic metals may be deposited on the phosphorus-treated carbon in the form of inorganic, organic or organometallic compounds of the metals, either sequentially or simultaneously, by various processes including incipient wetness impregnation, equilibrium adsorption etc., from aqueous or non-aqueous media, or from vapor phase using volatile compounds of catalysts can also be prepared by solid state synthesis techniques such as, for example, grinding together the support and the metal compounds in a single step or in multiple steps, with suitable heat treatments.

It is to be noted that the catalytic metals exist as oxides or as partially decomposed metal compounds which are precursors to the oxides in the prepared catalysts. All the metals can be deposited in any order on the carrier (support), either in a single step or in multiple steps via solid state techniques or solution impregnation from aqueous or non-aqueous media, with heat treatment in between.

The Group VIB metal may be loaded onto the catalyst support preferably from an aqueous solution of ammonium heptamolybdate or of ammonium metatungstate. The Group VIII non-noble metal may be loaded onto the catalyst support preferably from an aqueous solution of nickel nitrate hexahydrate or cobalt nitrate hexahydrate.

In a preferred embodiment, the phosphorus-treated carbon support containing the polyphosphate species is contacted with an aqueous solution of a salt of a Group VIB metal, preferably ammonium metatungstate $(NH_4)_6H_2W_{12}O_{40}$, in an amount to fill the pores to incipient wetness. The phosphorus treated carbon support bearing the Group VIB metals is typically allowed to stand at room temperature for 0.5–4 hours, preferably 2 hours, and then heated in air or inert atmosphere at a rate of 0.3° C./min to 115° C., maintained at that temperature for 12–48 hours, preferably 24 hours, and then cooled to room temperature over 2–6 hours, preferably 3 hours. Higher temperatures of up to 500° C. can be utilized. Multiple impregnations may be employed to prepare catalysts with desired Group VIB metal loading.

Thereafter, the support bearing the Group VIB metal is contacted with an aqueous solution of the non-noble Group VIII metal, preferably nickel nitrate hexahydrate, in amount to fill the pores to incipient wetness. The phosphorus-treated carbon support bearing Group VIB metal and Group VIII metal is typically allowed to stand at room temperature for 0.5–4 hours, preferably 2 hours, and then heated in air or inert atmosphere, at a rate of 0.3° C./min to 115° C., maintained at that temperature for 12–48 hours, preferably 24 hours, and then cooled to room temperature over 2–6 hours, preferably 3 hours. Higher temperatures up to 500° C. can be utilized. Multiple impregnations may be employed to prepare catalysts with desired Group VIII metal loading.

The catalyst so prepared contains 1–50%, preferably 5–18%, and more preferably 12% by weight, of molybdenum or chromium of Group VIB (measured as metal), and 0.1–15%, preferably 2–12%, more preferably about 7% by weight of Group VIII metal, preferably nickel (measured as metal) supported on the phosphorus-treated carbon support. When the VIB metal is the preferred tungsten it may be present in an amount of 1–50 wt. %, preferably 10–45 wt. %, more preferably 37 wt. %, calculated as elemental tungsten and based on the final catalyst weight.

The particle size or shape required for the process of the present invention is generally dictated by the reactor system utilized for practicing the invention. For example, in a visbreaker-like process employing a tubular reactor, finely ground catalyst is preferred. In an ebullated bed process, the catalyst in the form of extrudates, pellets, or spheres may be advantageously utilized.

The Group VIB and non-noble Group VIII metal catalyst supported on the phosphorus-treated carbon support may be sulfided to convert at least a significant portion of the Group VIB and Group VIII compounds to their respective sulfides before using in the process of the present invention. The sulfiding can be accomplished using any method known in the art such as, for example, heating the catalyst in a stream of hydrogen sulfide in hydrogen or by flowing an easily decomposable sulfur compound such as carbon disulfide, dimethyl disulfide, or di-t-nonyl polysulfide ("TNPS"), in a hydrocarbon solvent, elevated temperatures up to, but not limited to 450° C. at atmospheric or higher pressures, in the presence of hydrogen gas. Various methods of sulfiding the catalyst are described in U.S. Pat. No. 5,529,968. If the oxidic form of the catalyst is used in the process, it may be converted to the sulfidic form in situ, by reaction with the sulfur compounds present or generated from sulfur compounds originally existing in the hydrocarbon oil feed. Preferably, the sulfiding is effected by adding to the hydrocarbon feed easily decomposable sulfur compounds such as carbon disulfide, dimethyl disulfide or TNPS in sufficient concentrations. Most preferably, the hydrogen sulfide generated in the process from the decomposition of sulfur compounds present in the oil can be recycled back into the process (alternatively at a point before or after entry of the hydrocarbon oil feed into the reactor) which will help sulfide the catalyst in situ.

Referring again to FIG. 1, reactor 10 is preferably a simple tubular reactor with or without internal structures. Hydrogen is added to the hydrocarbon/catalyst slurry prior to entry of the feed into the reaction zone. Hydrogen is preferably added to the hydrocarbon/catalyst slurry prior to entry of the feed into the preheater before the reactor. The process conditions of the method of the present invention include a temperature of from about 250° C., to about 500° C. preferably about 380° C., to about 450° C.; a pressure of from about 200 psig to about 1,500 psig, preferably about 200 psig to about 1000 psig; a catalyst concentration in the slurry of from about 0.01% to about 10% by weight of the feed; a liquid hourly space velocity (LHSV) of from about 0.1 to about 5.0; and a gas flow of from about 100 to about 10,000 SCFB (Standard cubic feet per barrel) of hydrogen of at least about 60% purity. Other gases, such as nitrogen and fuel gas may also be used along with hydrogen.

As can be appreciated when using a heated reactor, formation of deposits on the interior surface of the metallic reactor is a severe disadvantage. Deposits not only obstruct the flow of reactants through the reactor tube, they also interfere with the transfer of heat through the wall of the reactor. Surprisingly, the method of the present invention minimizes the formation of deposits.

The effluent from the reactor 10 can optionally be sent to a soaker to undergo heat soaking where the oil might undergo further upgrading. The effluent may also be sent to one or more fractionators or flashing units to separate easily distillable oil components from the overall product. After the effluent slurry has been degassed, the catalyst is separated from the effluent slurry, for example, with the help of a filtration apparatus or a centrifuge 20. Any known technique can be used to separate the catalyst from the oil, including gravity separation. In some cases the catalyst separation from the upgraded oil may not be necessary. The resulting treated hydrocarbon oil product P can be sent to further processing or for sale. The catalyst can optionally be sent back to the hydrocarbon feed stream F via recycle stream R.

The following EXAMPLES 1 to 4 are provided for purposes of illustrating the catalyst assisted hydrotreating method of the present invention and are not intended as limitations of the invention. COMPARATIVE EXAMPLES A and B are provided to show the results of the prior known hydrotreating method without using the catalyst described herein.

EXAMPLE 1

A crude oil was provided having the properties set forth in Table 1 below. Composition percentages are by weight unless otherwise indicated:

TABLE 1

| (Properties of whole crude oil) | |
|---|---|
| API Gravity | 15° |
| Boiling Range (Weight %, Normalized) | |
| IBP | 151° C. |
| 10% | 261° C. |
| 50% | 425° C. |
| 90% | 616° C. |
| 99.9% | 710° C. |
| Percent boiling above 524° C. (Pitch) | 26% |
| Recovery in HTSIMDIS (High Temperature Simulated Distillation) | 91% |
| Composition (by weight) | |
| Sulfur content | 1.0% |
| Carbon content | 84.4% |
| Hydrogen content | 11.1% |
| Nitrogen content | 0.41% |
| Vanadium content | 14 ppm. |
| Nickel content | 4 ppm. |
| Iron content | 22 ppm. |
| Asphaltene content | 2% heptane insolubles |
| Water content | 1.5% |
| Total Acid Number (TAN) | 4.2 |

A stainless steel tubular reactor having a 19 mm inner diameter and 40 cm length was provided. The tube had no internal structures. The internal volume of the reactor in the heated zone was approximately 120 cc. Prior to running the experiment the weight of the reactor tube was determined.

A carbon supported Ni-W catalyst containing 37% W and 7.5% Ni, prepared in accordance with the procedure described in U.S. Pat. No. 5,529,968 was provided. The carbon support of the catalyst contained about 5% phosphorus. The catalyst was finely ground and the fraction passing through a 400 mesh screen was thoroughly blended with the crude oil in a high speed blender, 7.5 g of catalyst being added to 3,000 g of crude oil to form a reactor feed slurry. In this example no sulfiding agent was added to the reactor feed slurry.

The slurry was fed into the reactor at 140 g/hr with a hydrogen flow of about 600 cc/min. The reactor temperature was programmed to increase gradually to a predetermined reaction temperature of 417° C., in about 60 minutes and remain constant thereafter. The time when the temperature reached the predetermined reaction temperature was taken as the starting time of the reaction. The total pressure was then adjusted to the desired pressure of 400 psig.

Liquid product samples were collected at various reaction times on stream at one hour intervals and were degassed with the help of an ultrasonic bath before they were analyzed for their sulfur, carbon, hydrogen, and nitrogen contents. The sulfur content of the feed and product samples were determined by X-ray fluorescence spectroscopy ("XRF"). They were also analyzed by high temperature GC simulated distillation ("SIMDIS" or "HTSIMDIS") to determine their boiling ranges. The TAN values of the feed and product samples were determined by the D664 method. The concentration of impurities such as vanadium, nickel, iron, sodium, chlorine, magnesium, and calcium were also determined by XRF spectroscopy. Water concentrations were determined using Carl Fisher titration.

At the end of the run, light petroleum naphtha was pumped through the reactor at 400 cc/hr for one hour while the reactor cooled down to remove all remaining crude oil. The naphtha was then removed from the reactor by applying vacuum. The reactor was then weighed again, the difference between the final weight and the initial weight indicating the increase in weight attributable to deposits formed on the interior walls of the reactor.

The experimental results are summarized below in Table 2:

TABLE 2

(Summary of EXAMPLE 1)

| | |
|---|---|
| Reaction Conditions | |
| Feed rate | 140 g/hr |
| Reaction temperature | 417° C. |
| Sulfiding agent | None |
| Pressure | 400 psig |
| Hydrogen flow rate | 600 cc/min |
| Reaction Results (from product analysis) | |
| API Gravity increase | 3.5° |
| Sulfur reduction | 9% |
| TAN reduction | 50% |
| Pitch conversion | 12% |
| 50% boiling point | 390° C. |
| Reactor weight gain | negligible |

EXAMPLE 2

The experiment of this EXAMPLE was conducted with the same material and equipment as that of EXAMPLE 1 and performed in the same manner except that the reaction temperature was 430° C. The experimental results of this EXAMPLE are set forth below in Table 3:

TABLE 3

(Summary of EXAMPLE 2)

| | |
|---|---|
| Reaction Conditions | |
| Feed rate | 140 g/hr |
| Reaction temperature | 430° C. |
| Sulfiding agent | None |
| Pressure | 400 psig |
| Hydrogen flow rate | 600 cc/min |
| Reaction Results (from product analysis) | |
| API Gravity increase | 5.5° |
| Sulfur reduction | 13% |
| TAN reduction | 70% |
| Pitch conversion | 38% |
| 50% boiling point | 348° C. |
| Reactor weight gain | negligible |

EXAMPLE 3

The experiment of this EXAMPLE was conducted with the same material and equipment as that of EXAMPLE 1 and performed in the same manner except that the reaction temperature was 425° C., the feed rate was 100 g/hr, and the hydrogen flow rate was 450 cc/min. Moreover 60 g of the sulfiding agent TNPS was added to the oil before blending with the catalyst. The experimental results of this EXAMPLE are set forth below in Table 4:

TABLE 4

(Summary of EXAMPLE 3)

| | |
|---|---|
| Reaction Conditions | |
| Feed rate | 100 g/hr |
| Reaction temperature | 425° C. |
| Sulfiding agent | TNPS |
| Pressure | 400 psig |
| Hydrogen flow rate | 450 cc/min |
| Reaction Results (from product analysis) | |
| API Gravity increase | 6.0° |
| Sulfur reduction | 15% |
| TAN reduction | 88% |
| Pitch conversion | 46% |
| 50% boiling point | 318° C. |
| Reactor weight gain | negligible |

EXAMPLE 4

The experiment of this EXAMPLE was conducted with the same material and equipment as that of EXAMPLE 3 and performed in the same manner except that the reaction temperature was 434° C., and the hydrogen feed rate was increased to 800 cc/min. The experimental results of this EXAMPLE are set forth below in Table 5:

TABLE 5

(Summary of EXAMPLE 4)

| | |
|---|---|
| Reaction Conditions | |
| Feed rate | 100 g/hr |
| Reaction temperature | 434° C. |
| Sulfiding agent | TNPS |
| Pressure | 400 psig |
| Hydrogen flow rate | 800 cc/min |
| Reaction Results (from product analysis) | |
| API Gravity increase | 8.0° |
| Sulfur reduction | 20% |
| TAN reduction | approx. 100% |
| Pitch conversion | 58% |
| 50% boiling point | 311° C. |
| Reactor weight gain | negligible |

Comparative Example A

The experiment of this COMPARATIVE EXAMPLE was conducted with the same material and equipment as that of EXAMPLE 1 and performed in the same manner except that the crude oil feed was reacted without catalyst or sulfiding agent. The reaction was conducted at a temperature of 424° C. at a pressure of 400 psig. The hydrogen flow was 800 cc/min and the feed rate was 105 g/hr. The results of this COMPARATIVE EXAMPLE are set forth below in Table 6:

TABLE 6

(Summary of COMPARATIVE EXAMPLE A)

| Reaction Conditions | |
|---|---|
| Feed rate | 105 g/hr |
| Reaction temperature | 423° C. |
| Sulfiding agent | None |
| Pressure | 400 psig |
| Hydrogen flow rate | 800 cc/min |
| Catalyst | None |
| Reaction Results (from product analysis) | |
| API Gravity increase | 5.0° |
| Sulfur reduction | none |
| TAN reduction | 67% |
| Pitch conversion | 31% |
| 50% boiling point | 358° C. |

Comparative Example B

The experiment of this COMPARATIVE EXAMPLE was conducted immediately after that of COMPARATIVE EXAMPLE A, without stopping the reaction. The experiment of this COMPARATIVE EXAMPLE was conducted with the same material and equipment as that of COMPARATIVE EXAMPLE A and performed in the same manner except that the reaction was conducted at a temperature of 435° C., and the feed rate was 110 g/hr. The results of this COMPARATIVE EXAMPLE are set forth below in Table 7:

TABLE 7

(Summary of COMPARATIVE EXAMPLE B)

| Reaction Conditions | |
|---|---|
| Feed rate | 110 g/hr |
| Reaction temperature | 435° C. |
| Sulfiding agent | None |
| Pressure | 400 psig |
| Hydrogen flow rate | 800 cc/min |
| Catalyst | None |
| Reaction Results (from product analysis) | |
| API Gravity increase | 7.0° |
| Sulfur reduction | 5% |
| TAN reduction | 88% |
| Pitch conversion | 46% |
| 50% boiling point | 323° C. |
| Reactor weight gain | 160 g |

As can be seen from the above results shown in Tables 2 to 7 the method of the present invention substantially reduces the TAN of whole crude oil while also improving its API gravity and reducing its sulfur content. Substantial reduction of TAN can also be achieved by the thermal hydrotreating reaction alone (COMPARATIVE EXAMPLES A and B, wherein no catalyst was used). However, the thermal hydrotreating process without catalyst cannot be run for significant lengths of time because of the formation of large amounts of deposits in the interior of the reactor tube. In contrast to the thermal non-catalytic process, the catalyst assisted process of the present invention greatly reduces the formation of deposits and thereby allows the treating process to be performed simply, efficiently, and continuously in a simple reactor system.

It will be understood that various modifications may be made to the embodiments disclosed herein. Therefore the above description should not be viewed as limiting, but merely as exemplifications of preferred embodiments. Those skilled in the art will envision other modifications within the scope and spirit of the claims appended hereto.

What is claimed is:

1. A process for treating a heavy hydrocarbon oil feed comprising:

a) forming a slurry which includes a heavy hydrocarbon oil and a catalytically effective amount of a catalyst composition comprising a non-noble metal of Group VIII of the periodic table and a metal of Group VIB of the periodic table on a phosphorus-treated carbon support;

b) introducing said slurry into a reaction zone in the presence of hydrogen; and, c) subjecting the slurry to acid number reducing conditions to provide a hydrocarbon oil product having an improved API gravity.

2. The process of claim 1 wherein the hydrocarbon oil product further has a lower acid number.

3. The process of claim 1 wherein the catalyst includes from about 0.1% to about 15% by weight of at least one metal selected from iron, cobalt and nickel, and from about 1% to about 50% by weight of at least one metal selected from chromium, molybdenum and tungsten, and the phosphorus-treated carbon support is characterized by:

(1) having been prepared by heat treating mixtures of activated carbon and phosphorus compounds at temperatures greater than 450° C.;

(2) the phosphorus existing in the phosphorus treated carbon being bound to the carbon surface predominantly as polyphosphate species characterized by peaks between −5 and −30 ppm in the solid-state magic angle spinning $^{31}P$ nuclear magnetic resonance spectrum; and (3) having a B.E.T. surface area of between 100 $m^2/g$ and 2000 $m^2/g$, a total pore volume for nitrogen of at least 0.3 ml/g and an average pore diameter of between 12 Angstroms (Å) and 100 Å.

4. The process of claim 1 wherein the hydrocarbon oil feed comprises an oil selected from the group consisting of whole crude oil, dewatered crude oil, desalted crude oil, topped crude oil, deasphalted oil, vacuum gas oils, petroleum residua, water emulsion of crude oil, water emulsions of heavy fractions of crude oils, oil from coal liquefaction, shale oil and tar sand oil.

5. The process of claim 1 wherein the hydrocarbon oil feed has a total acid number of at least 0.3 and an API gravity of no more than 25°.

6. The process of claim 1 wherein the hydrocarbon oil feed has no measurable total acid number and an API gravity of no more than 25°.

7. The process of claim 1 wherein the slurry is a substantially uniform suspension of the catalyst in the hydrocarbon oil feed.

8. The process of claim 1 further including the step of separating out the catalyst from the hydrocarbon oil product and recycling the separated catalyst, with or without regeneration, to the hydrocarbon oil feed.

9. The process of claim 1 wherein the acid number of the hydrocarbon oil product is less than about 50% that of the hydrocarbon oil feed.

10. The process of claim 1 wherein the API gravity of the hydrocarbon oil product is at least about 1° higher than that of the hydrocarbon oil feed.

11. The process of claim 1 wherein the acid number reducing conditions include a reaction temperature of from about 250° C., to about 500° C., a pressure of from about 200 psig to about 1,500 psig, a liquid hourly space velocity of from about 0.1 to about 5.0, and a hydrogen feed rate of from about 100 to about 10,000 SCFB.

12. The process of claim 11 wherein the reaction temperature is from about 380° C., to about 450° C., and the reaction pressure is from about 200 psig to about 1,000 psig.

13. The process of claim 1 wherein the catalyst concentration in the slurry is from about 0.01% to about 10% by weight.

14. The process of claim 1 wherein the catalyst is used without presulfiding.

15. The process of claim 1 wherein the catalyst is presulfided.

16. The process of claim 1 wherein the catalyst is sulfided in situ by adding a decomposable sulfur compound to the hydrocarbon oil feed before passing the slurry into the reaction zone.

17. The process of claim 1 wherein a portion of hydrogen sulfide generated in the process is recycled back into the process.

18. The process of claim 1 wherein the catalyst contains from about 1% to about 20% by weight of at least one metal selected from chromium and molybdenum.

19. The process of claim 1 wherein the catalyst contains from about 1% to about 50% tungsten by weight.

20. The process of claim 1 wherein the catalyst contains about 2% to about 12% of nickel and about 10% to about 45% tungsten, and the carbon support contains about 2.5% to about 10% phosphorus by weight.

21. The process of claim 1 wherein the catalyst includes from about 0.01% to about 4% by weight of a promoter selected from the group consisting of boron and fluorine.

22. The process of claim 1 further including the step of heat soaking the hydrocarbon oil product.

23. The process of claim 1 wherein the hydrogen used is of at least 60% purity.

* * * * *